US010123642B2

(12) United States Patent
Gazibara

(10) Patent No.: US 10,123,642 B2
(45) Date of Patent: Nov. 13, 2018

(54) HANDHELD HYDRATION HOLDER

(71) Applicant: Adnan Gazibara, Westminster, CO (US)

(72) Inventor: Adnan Gazibara, Westminster, CO (US)

( * ) Notice: Subject to any disclaimer, the term of this patent is extended or adjusted under 35 U.S.C. 154(b) by 71 days.

(21) Appl. No.: 15/156,102

(22) Filed: May 16, 2016

(65) Prior Publication Data

US 2017/0325575 A1 Nov. 16, 2017

(51) Int. Cl.

| | |
|---|---|
| ***B65D 25/34*** | (2006.01) |
| ***A47G 23/02*** | (2006.01) |
| ***B65D 23/10*** | (2006.01) |
| *A45F 5/10* | (2006.01) |

(52) U.S. Cl.

CPC ..... *A47G 23/0241* (2013.01); *B65D 23/106* (2013.01); *A45F 2005/1006* (2013.01); *A45F 2005/1013* (2013.01); *A45F 2200/0583* (2013.01)

(58) Field of Classification Search

CPC ..... A45F 5/10; A45F 3/16; A47G 23/0241; B65D 23/104; B65D 25/20; A45C 2200/20

USPC ..... 220/592.17, 592.24, 737, 739, 752, 757, 220/903; 215/12.1; 224/148.6

See application file for complete search history.

(56) References Cited

U.S. PATENT DOCUMENTS

| | | | | |
|---|---|---|---|---|
| 1,605,195 | A | 11/1926 | Lewis | |
| 2,331,085 | A | 10/1943 | Sterling | |
| 4,197,890 | A | 4/1980 | Simko | |
| 4,526,280 | A | 7/1985 | Taylor | |
| 5,294,028 | A | 3/1994 | Bankroff | |
| 5,325,991 | A | 7/1994 | Williams | |
| 5,680,958 | A * | 10/1997 | Mann | A45F 3/14 220/739 |
| 5,810,218 | A | 9/1998 | Falcaro | |
| 5,901,882 | A | 5/1999 | Siegel | |
| 6,004,033 | A | 12/1999 | Cirone | |
| 6,073,796 | A * | 6/2000 | Mogil | A45F 3/16 215/12.1 |
| 6,401,993 | B1 | 6/2002 | Andrino | |
| 7,828,195 | B2 | 11/2010 | Edmondson | |
| 2001/0040380 | A1 | 11/2001 | Forjone | |
| 2007/0051735 | A1 | 3/2007 | Taylor et al. | |
| 2012/0187160 | A1 | 7/2012 | Wolf | |
| 2013/0146623 | A1 | 6/2013 | Murray | |
| 2015/0264986 | A1* | 9/2015 | Coleman | A45F 3/042 362/156 |
| 2016/0249758 | A1* | 9/2016 | Neiley | A47G 23/0241 215/396 |

* cited by examiner

*Primary Examiner* — J. Gregory Pickett

*Assistant Examiner* — Elizabeth Volz

(74) *Attorney, Agent, or Firm* — John A. Arsenault; Daniel M. Dubuisson

(57) ABSTRACT

A hydration holder and method for manufacturing the same from a single sheet of stretchable fabric is disclosed. The hydration holder comprises a bottle holder and has an elongated strip extending therefrom and fastening to the bottle holder in multiple locations to form an upper loop, an inner handle member, and an outer handle member, wherein the outer handle member reversibly fastens to the inner handle member. Cutouts in the center and lower sections increase the capacity of the hydration holder to accommodate large bottles.

17 Claims, 2 Drawing Sheets

HANDHELD HYDRATION HOLDER

STATEMENT REGARDING FEDERALLY SPONSORED RESEARCH AND DEVELOPMENT

Not Applicable.

CROSS-REFERENCE TO RELATED APPLICATIONS

This application is related to and/or claims the benefit of the earliest available effective filing date(s) from the following listed application(s) (the "Priority Applications"), if any, listed below (e.g., claims earliest available priority dates for other than provisional patent applications or claims benefits under 35 USC § 119(e) for provisional patent applications, for any and all parent, grandparent, great-grandparent, etc. applications of the Priority Application(s)). In addition, the present application is related to the "Related Applications," if any, listed below.

BACKGROUND OF DISCLOSURE

1. Field of Invention

The present invention relates generally to a hydration bottle holders and more particularly to a personal hydration bottle system for providing drinking fluids to a user.

2. Description of Prior Art

Several systems are known to provide vital fluids to a user. U.S. Pat. No. 5,294,028 to Bankroff discloses a container transport assembly comprising first and second cylindrical housings coaxially aligned and secured together by strap portions to receive a bottle, wherein the bottle structure is arranged for receiving a support strap. U.S. Pat. No. 6,004,033 to Cirone discloses a neoprene water bottle holder formed by sewing a first edge of a neoprene sheet to a second edge of a sheet of material to form a cylindrically shaped holder with a fastener attachment mechanism for allowing the holder to be selectively and reversibly attached to exercise equipment or other structures. None of the prior art disclose an apparatus capable of housing a variety of bottle sizes or being foldable or flattenable for storage, nor does the prior art disclose a hydration holder with an adjustable handle designed to prevent injury and discomfort in the hand of a user.

A comprehensive hydration holder has been long sought which may be manufactured from a single sheet of fabric, is a universal fit for many sizes of hydration bottles and would have an adjustable grip that prevents slippage when the supported hydration bottle sweats. The presently disclosed invention addresses these disadvantages and others, as described in the embodiments herein.

SUMMARY OF THE DISCLOSURE

The present invention provides an apparatus for a user to having accessibility to a beverage bottle during gait or during athletic activities and a method of manufacturing the same. In a preferred embodiment, the hydration holder comprises a bottle holder having a lower portion and an upper portion, an elongated strip extending from the upper portion along a longitudinal centerplane and being fastened to the upper portion via a first fastener strip to form an upper loop, wherein the first fastener strip is oriented transversely and substantially perpendicular to the longitudinal centerplane, whereby the elongated strip further extends towards and is retained towards the lower portion via a second fastener strip thereby defining an inner handle member, wherein the second fastener strip is oriented transversely and substantially perpendicular to the longitudinal centerplane, whereby the elongated strip further extends towards and terminates proximate to the upper portion thereby defining an outer handle member, and wherein the outer handle member is reversibly fastenable to the inner handle member via a handle member fastening means.

In an embodiment, the bottle holder further comprises two holder center cutouts oppositely positioned about the bottle holder and intersecting the longitudinal centerplane. The bottle holder may comprise two holder lower cutouts oppositely positioned about the bottle holder and not intersecting the longitudinal centerplane. The bottle holder may further comprise a reflective or visually contrasting tape positioned proximate to the lower portion and interconnecting the two holder center cutouts along the longitudinal centerplane.

In an embodiment, the first fastener strip or the second fastener strip comprises a slide adjuster comprising a first opening and may further comprise a second opening, whereby the elongated strip passes through the first opening and the second opening. The slide adjuster is generally manufactured from a material such as nickel, other metals, and substantially rigid polymers.

In an embodiment, the handle member fastening means is whereby a first fastener tape positioned on the inner handle member reversibly fastens with a second fastener tape positioned on the outer handle member. In an embodiment, the inner handle member further comprises two oppositely directed convexly rounded flaps. One or more of the holder center cutouts may take a form substantially matching the form of the inner handle member. One or more of the holder center cutouts may be convexly rounded away from the longitudinal centerplane In embodiments with holder lower cutouts, one or more of the holder lower cutouts may take a form of one or two first cuts oriented parallel to the longitudinal centerplane and one or two second cuts oriented transversely and substantially perpendicular to the longitudinal centerplane, whereby one or two of the first cuts intersect with one or two of the second cuts.

In an embodiment, the hydration holder further comprises a reflective or visually contrasting perimeter oriented along one or more edges therein. In an embodiment, the hydration holder further comprises a pocket positioned internally or externally and being accessible externally via a pocket opening. In a further embodiment, the pocket opening is positioned proximate to the upper portion and oriented substantially tangential about the bottle holder. In a further embodiment, the pocket opening further comprises a zip fastener for preventing contents within the pocket from undesirably exiting the pocket. In an example embodiment, the pocket is positioned adjacent to a first stitching line so as to keep the first stitching line hidden. In an alternative embodiment, the pocket is fastened externally to the bottle holder after first stitching lines and are stitched together and is centered about the first stitching line.

In an embodiment, the upper loop comprises two concavely rounded cuts. In several embodiments, the hydration holder is manufactured from a material selected from the group consisting of neoprene, chloroprenes, four way stretch fabrics and elastanes.

A method for manufacturing a hydration holder from one sheet of fabric generally comprises the steps of fastening together the one sheet of fabric along a first stitching line to form a bottle holder, fastening together the one sheet of fabric along a second stitching line to form two holder lower cutouts, fastening the elongated strip to the upper portion via a first fastener strip thereby forming an upper loop, fastening the elongated strip to the lower portion via a second fastener strip thereby forming an inner handle member, and reversibly fastening via a handle member fastening means the inner handle member to the elongated strip distal to the first fastener strip, wherein the first fastener strip is oriented transversely and substantially perpendicular to the longitudinal centerplane, and wherein the second fastener strip is positioned distal to the first fastener strip and is oriented transversely and substantially perpendicular to the longitudinal centerplane. In an embodiment, the method further comprises the step of cutting away one or more holder center cutouts oppositely positioned about the bottle holder and intersecting the longitudinal centerplane.

Embodiments include one, more, or any combination of all of the features listed above.

Other features and advantages of the present invention will become apparent from the following more detailed description, taken in conjunction with the accompanying, which illustrate, by way of example, the principles of the invention.

Figure 1:
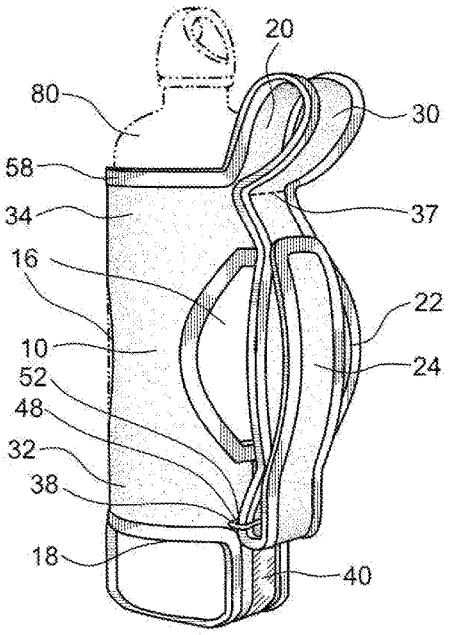
FIG. 1 is a perspective view of a hydration holder, in accordance with an exemplary embodiment of the present invention.

REFERENCE NUMERALS IN THE DRAWINGS bottle holder 10
first elongated strip 12
second elongated strip 14
holder center cutout 16
holder lower cutout 18
elongated strip 20
inner handle member 22
outer handle member 24
first fastener tape 26
second fastener tape 28
upper loop 30
lower portion 32
upper portion 34
first fastener strip 37
second fastener strip 38
reflective or visually contrasting tape 40
first stitching lines 42
second stitching lines 44
slide adjuster 48
dual looped slide adjuster 50
first opening 52
second opening 53
perimeter 58
zip fastener 60
convexly rounded flaps 62
concavely rounded cuts 64
first cut 66
second cut 68
pocket 70
pocket opening 72
pocket longitudinal stitching line 74
bottle 80
longitudinal centerplane 100

DETAILED DESCRIPTION OF THE DISCLOSED EMBODIMENT

Illustrative embodiments of the invention are described below in the accompanying Figures. The following detailed description provides detailed schematics for a thorough understanding of and an enabling description for these embodiments. One having ordinary skill in the art will understand that the invention may be practiced without certain details. In other instances, well-known structures and functions have not been shown or described in detail to avoid unnecessarily obscuring the description of the embodiments.

Figure 2:
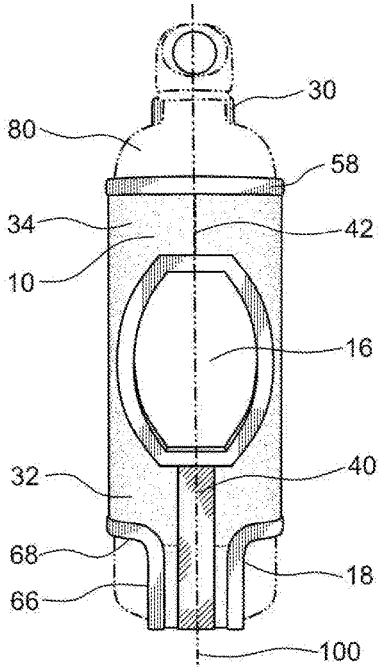
FIG. 2 is a side view of the hydration holder in FIG. 1, in accordance with an exemplary embodiment of the present invention.

FIG. 1 is a perspective view of a hydration holder, in accordance with an exemplary embodiment of the present invention. FIG. 2 is a side view of the hydration holder in FIG. 1, in accordance with an exemplary embodiment of the present invention. The hydration holder comprises a bottle holder 10 having two holder center cutouts 16 intersecting the longitudinal centerplane 100 and oppositely positioned about the bottle holder 10, two holder lower cutouts 18 not intersecting the longitudinal centerplane 100 and oppositely positioned about the bottle holder 10, a reflective or visually contrasting tape 40 mounted towards the lower portion 32 of the bottle holder 10 and interconnecting the two holder center cutouts 16 along the longitudinal centerplane 100, and an elongated strip 20 extending from the upper portion 34 of the bottle holder 10 along the longitudinal centerplane 100 and being fastened to the upper portion 34 via a first fastener strip 37 to form an upper loop 30 for securing the hydration holder to a belt, loop, or bar, wherein the first fastener strip 37 is oriented transversely and substantially perpendicular to the longitudinal centerplane 100.

Beyond the upper loop 30, the elongated strip 20 extends towards the lower portion 32 of the bottle holder 10 and is retained towards the lower portion 32 via a second fastener strip 38 defining an inner handle member 22 between the first fastener strip 37 and the second fastener strip 38, whereby the elongated strip 20 further extends towards and terminates proximate to the upper portion 34 defining an outer handle member 24 beyond the second fastener strip 38. The outer handle member 24 is reversibly fastenable to the inner handle member 22 via a handle fastening means.

In the example embodiments shown in FIG. 1 and FIG. 2, the first fastener strip 37 takes the form of stitching of the elongated strip 20 to the upper portion 34, and the second fastener strip 38 takes the form of a slide adjuster 48 fastened to the lower portion 32 and oriented transversely and substantially perpendicular to the longitudinal centerplane 100. The elongated strip 20 passes through a first opening 52 in the slide adjuster 48, which allows a user to adjust the size and curvature of the inner handle member 22, as desired. The slide adjuster 48 is manufactured from a substantially rigid material, which may include, but is not limited to nickel plated materials, metals, or substantially rigid polymers. The reflective or visually contrasting tape 40 increases visibility and awareness of the user to other persons, which is especially important during night time and in areas of low visibility. In some embodiments, the hydration holder further comprises a reflective or visually contrasting perimeter 58 oriented along one or more edges therein; this further benefits embodiments incorporating center cutouts 16 and lower cutouts 18 by supplying more edges for the reflective or visually contrasting perimeter 58.

Preferably in some embodiments, the form of one or more of the holder lower cutouts 18 is whereby one or two first cuts 66 are oriented parallel to the longitudinal centerplane 10 and one or two second cuts 68 are oriented transversely and substantially perpendicular to the longitudinal centerplane 100, and whereby one or two of the first cuts intersect with one or two of the second cuts 68 to define the form of the holder lower cutout 18.

Figure 3:
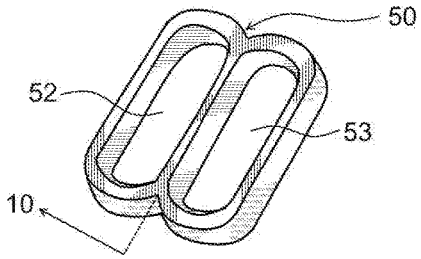
FIG. 3 is a perspective view of a dual looped slide adjuster that may be implemented as a first fastener strip or a second fastener strip, in accordance with an exemplary embodiment of the present invention.

FIG. 3 is a perspective view of a dual looped slide adjuster 50 that may be implemented as a first fastener strip 37 or a second fastener strip 38, in accordance with an exemplary embodiment of the present invention. In embodiments that utilize a dual looped slide adjuster 50, the elongated strip 20 initally passes through the first opening 52 then the second opening 53 of the slide adjuster 50 for increasing capability of a user to adjust the size and curvature of the inner handle member 22 for accommodating a variety of hand sizes. The adjustability of size and the form of the inner handle member 22 are particularly beneficial for elderly users by allowing the inner handle member 22 to be ideally configured for accommodating users with arthritis and other physical limitations.

Figure 4:
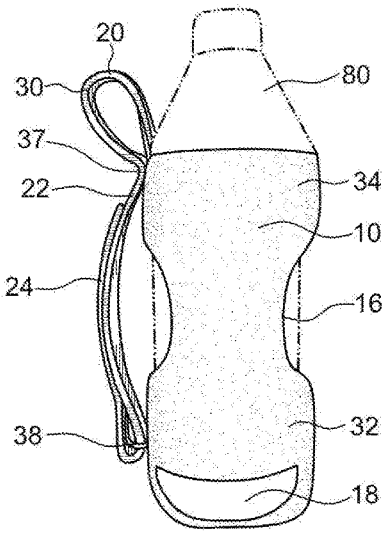
FIG. 4 is a front view of a hydration holder wherein a large sized bottle is secured in the bottle holder, in accordance with an exemplary embodiment of the present invention.

FIG. 4 is a front view of a hydration holder wherein a large sized bottle 80 is secured in the bottle holder 10, in accordance with an exemplary embodiment of the present invention. A bottle holder 10 comprising center cutouts 16 or lower cutouts 18 grants visibility of contents stored within a bottle 80 to a user without having to remove the bottle 80 from the bottle holder 10. Furthermore, incorporation of center cutouts 16 or lower cutouts 18 into the bottle holder 10 allows for the hydration holder to flexibly accommodate larger sized bottles 80 than would otherwise fit.

Figure 5:
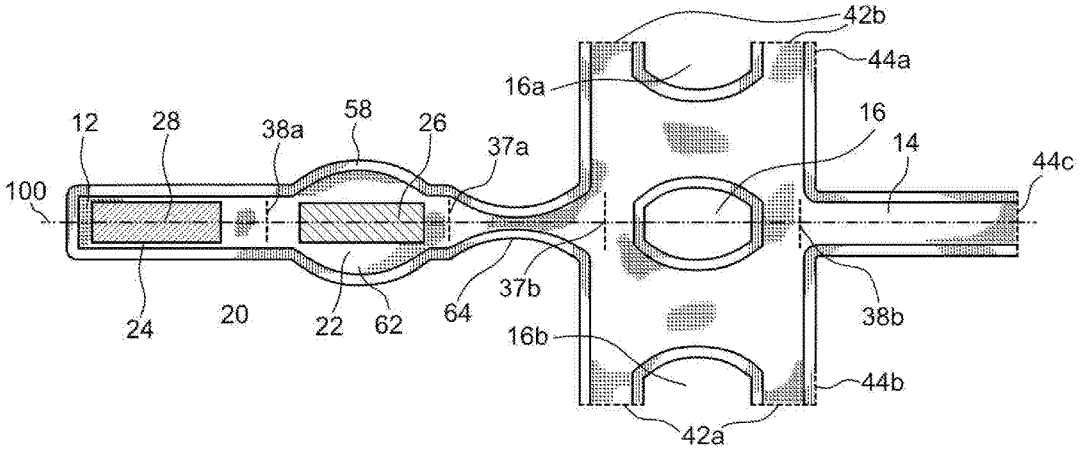
FIG. 5 is a design view of a hydration holder showing the elongated strip prior to assembling the inner handle member and outer handle member and showing the bottle holder prior to stitching along first stitching lines and second stitching lines, in accordance with an exemplary embodiment of the present invention.

FIG. 5 is a design view of a hydration holder showing the elongated strip 20 prior to assembling the inner handle member 22 and outer handle member 24 and showing the bottle holder 10 prior to stitching along first stitching lines 42*a* and 42*b* and second stitching lines 44*a*, 44*b*, and 44*c*, in accordance with an exemplary embodiment of the present invention. The hydration holder is manufacturable from a single sheet of an elastic material. The handle fastening means may be whereby the inner handle member 22 reversibly fastens to the outer handle member 24 via a first fastener tape 26 positioned on the outer surface of the inner handle member 22 and a second fastener tape 28 positioned on the inner surface of the outer handle member 24, wherein the first fastener tape 26 and second fastener tap 28 may be attracted to each other by magnetic force or restricted from separation by mechanical friction. In the example embodiments shown in FIGS. 1-2 and FIG. 5, the inner handle member 22 comprises two oppositely directed convexly rounded flaps 62 extending transversely to the elongated strip 20. In the example embodiment shown in FIG. 5, the upper loop 30 comprises two concavely rounded cuts 64 for preventing injury to a user upon rotation of the hydration holder about a thumb or other digits.

In the example embodiment of FIG. 5, the hydration holder may be assembled by initially stitching together first stitching lines 42*a* to 42*b* to form a bottle holder 10 that is cylindrical or tubular, then stitching together second stitching lines 44*a* and 44*b* to 44*c*. The inner handle member 22 and outer handle member 24 are formed by conjoining 37*a* and 37*b* to define a first fastener strip 37, and by conjoining 38*a* and 38*b* to define a second fastener strip 38.

Preferably in some embodiments, one or more of the holder center cutouts 16 takes a form similar to the form of the inner handle member 22, such as in the example embodiments in FIGS. 1-2 and FIG. 5, whereby holder center cutouts 16 is designed to substantially match the form of the flapped portion of the elongated strip 20 by being convexly rounded away from the longitudinal centerplane 100.

Figure 6:
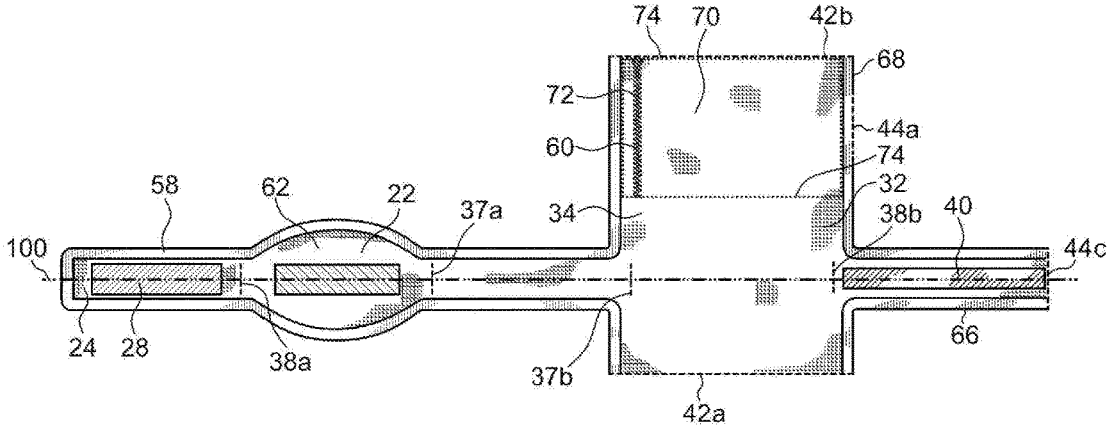
FIG. 6 is a design view of a hydration holder equipped with a pocket, showing the elongated strip prior to assembling the inner handle member and outer handle member and showing the bottle holder prior to stitching along first stitching lines and second stitching lines, in accordance with an exemplary embodiment of the present invention.

FIG. 6 is a design view of a hydration holder equipped with a pocket 70, showing the elongated strip 20 prior to assembling the inner handle member 22 and outer handle member 24 and showing the bottle holder 10 prior to stitching along first stitching lines 42*a* and 42*b* and second stitching lines 44*a* and 44*c*, in accordance with an exemplary embodiment of the present invention. The pocket 70, also manufactured from an elastic material, is positioned internally or externally and is accessible from the exterior via a pocket opening 72 positioned towards the upper portion 34 and oriented substantially tangential about the bottle holder 10. In an embodiment, the pocket 70 is manufactured from a water resistant material for outdoor use. Preferably in some embodiments, the pocket opening 72 further comprises a zip fastener 60, which may be a metal zip fastener, a partially flexible polymer zip fastener, a hook and loop fastener, or magnetic zip fastener, for preventing contents within the pocket 70 from undesirably exiting. In the example embodiment in FIG. 6, the pocket 70 is positioned adjacent to a first stitching line 42*a* or 42*b* with a pocket longitudinal stitching line 74 aligned parallel to and overlapping first stitching line 42*b* so as to keep the first stitching line 42 hidden. In an alternative embodiment, the pocket 70 is fastened externally to the bottle holder 10 after first stitching lines 42*a* and 42*b* are stitched together and is centered about the first stitching line 42.

In an embodiment, the elongated strip 20 is further defined as a first elongated strip 12, and a second elongated strip 14 extends from the lower portion of bottle holder 10 along the longitudinal centerplane 100 and is fastened along a second stitching line to the lower portion 32 substantially opposite about the bottle holder 10, thus forming two holder lower cutouts 18.

The hydration holder disclosed herein provides substantial benefit to athletes and to users who desire quick access to a beverage during gait. The hydration holder is manufactured from a lightweight durable elastic material, which may include, but is not limited to, neoprene, chloroprenes, four way stretch fabrics and elastanes. This allows the hydration holder to accommodate many sizes of bottles 80 and be easily folded or flattened for storage. If a disposable bottle 80 is utilized, a user can discard the bottle 80, place a wrist through the holder center cutouts 16, or simply fold the hydration holder for storage, and continue on unencumbered. Furthermore, the hydration holder is operable for both warm and cold beverages and provides an exceptional safeguard to a bottle 80 by protecting it from scrapes and scratches. If a bottle 80 sweats or condenses a liquid thereon the surface, the bottle holder 10 will absorb that liquid without becoming slippery and will evaporate more readily.

The method for manufacturing a hydration holder disclosed herein from a single sheet of fabric generally comprises the steps of fastening together the one sheet of fabric along first stitching lines 42 to form a bottle holder 10, fastening together the one sheet of fabric along second stitching lines 44 to form two holder lower cutouts 18, fastening the elongated strip 20 to the upper portion 34 via a first fastener strip 37 thereby forming an upper loop 30, fastening the elongated strip 20 to the lower portion 32 via a second fastener strip 38 thereby forming an inner handle member 22, and reversibly fastening the elongated strip 20 at the distal end portion to the inner handle member 22 via a handle member fastening means, wherein the first fastener strip 26 is oriented transversely and substantially perpendicular to the longitudinal centerplane 100, and wherein the second fastener strip 28 is positioned distal to the first fastener strip 26 and is oriented transversely and substantially perpendicular to the longitudinal centerplane 100. The method may further comprise the step of cutting away one or more holder center cutouts 16 oppositely positioned about the bottle holder 10 and intersecting the longitudinal centerplane 100.

While particular embodiments of the invention have been described and disclosed in the present application, it is clear that any number of permutations, modifications, or embodiments may be made without departing from the spirit and the scope of this invention. Accordingly, it is not the inventor's intention to limit this invention in this application, except as by the claims.

Particular terminology used when describing certain features or aspects of the invention should not be taken to imply that the terminology is being redefined herein to be restricted to any specific characteristics, features, or aspects of the invention with which that terminology is associated. In general, the terms used in the claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise embodiment or form disclosed herein or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

In general, the terms used in the claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

In light of the above "Detailed Description," Inventor may make changes to the invention. While the detailed description outlines possible embodiments of the invention and discloses the best mode contemplated, no matter how detailed the above appears in text, the invention may be practiced in a myriad of ways. Thus, implementation details may vary considerably while still being encompassed by the spirit of the invention as disclosed by the inventor. As discussed herein, specific terminology used when describing certain features or aspects of the invention should not be taken to imply that the terminology is being redefined herein to be restricted to any specific characteristics, features, or aspects of the invention with which that terminology is associated.

What is claimed is:

1. A hydration holder, said hydration holder comprising:

a bottle holder having a lower portion and an upper portion;

an elongated strip extending from said upper portion along a longitudinal centerplane and being fastened to said upper portion via a first fastener strip to form an upper loop, wherein said first fastener strip is oriented transversely and substantially perpendicular to said longitudinal centerplane;

whereby said elongated strip further extends towards and fastens to said lower portion via a second fastener strip thereby defining an inner handle member, wherein said second fastener strip is oriented transversely and substantially perpendicular to said longitudinal centerplane;

whereby said elongated strip further extends towards and terminates proximate to said upper portion thereby defining an outer handle member;

wherein said outer handle member is reversibly fastenable to said inner handle member via a handle member fastening means; and wherein said bottle holder further comprises two holder center cutouts oppositely positioned about said bottle holder and intersecting said longitudinal centerplane.

2. The hydration holder according to claim 1, wherein said bottle holder further comprises a reflective or visually contrasting tape positioned proximate to said lower portion and interconnecting said two holder center cutouts along said longitudinal centerplane.

3. The hydration holder according to claim 1, wherein said first fastener strip or said second fastener strip further comprise a slide adjuster comprising a first opening and a second opening, whereby said elongated strip passes through said first opening and said second opening.

4. The hydration holder according to claim 3, wherein said slide adjuster is manufactured from a material selected from the group consisting of nickel, metals, and substantially rigid polymers.

5. The hydration holder according to claim 1, wherein said handle member fastening means comprises a first fastener tape positioned on said inner handle member reversibly fastens with a second fastener tape positioned on said outer handle member.

6. The hydration holder according to claim 1, wherein said inner handle member further comprises two oppositely directed convexly rounded flaps.

7. The hydration holder according to claim 1, wherein one or more said holder center cutouts takes a form substantially matching said inner handle member.

8. The hydration holder according to claim 1, further comprising a reflective or visually contrasting perimeter oriented along one or more edges therein.

9. The hydration holder according to claim 1, wherein said bottle holder further comprises a pocket accessible externally via a pocket opening.

10. The hydration holder according to claim 9, wherein said pocket opening is positioned proximate to said upper portion and oriented substantially tangential about said bottle holder.

11. The hydration holder according to claim 10, wherein said pocket opening further comprises a zip fastener for preventing contents within said pocket from undesirably exiting said pocket.

12. The hydration holder according to claim 1, wherein one or more said holder center cutouts is convexly rounded away from said longitudinal centerplane.

13. The hydration holder according to claim 1, wherein said hydration holder is manufactured from a material selected from the group consisting of neoprene, chloroprenes, four way stretch fabrics and elastanes.

14. The hydration holder according to claim 1, wherein said upper portion and said elongated strip are formed from a single sheet of fabric.

15. A hydration holder, said hydration holder comprising:

a bottle holder having a lower portion and an upper portion;

an elongated strip extending from said upper portion along a longitudinal centerplane and being fastened to said upper portion via a first fastener strip to form an upper loop, wherein said first fastener strip is oriented transversely and substantially perpendicular to said longitudinal centerplane;

whereby said elongated strip further extends towards and fastens to said lower portion via a second fastener strip thereby defining an inner handle member, wherein said second fastener strip is oriented transversely and substantially perpendicular to said longitudinal centerplane;

whereby said elongated strip further extends towards and terminates proximate to said upper portion thereby defining an outer handle member;

wherein said outer handle member is reversibly fastenable to said inner handle member via a handle member fastening means; and wherein said bottle holder further comprises two holder lower cutouts oppositely positioned about said bottle holder and not intersecting said longitudinal centerplane.

16. The hydration holder according to claim 15, wherein one or more said holder lower cutouts takes a form of one or two first cuts oriented parallel to said longitudinal centerplane and one or two second cuts oriented transversely and substantially perpendicular to said longitudinal centerplane, whereby one or two said first cuts intersect with one or two said second cuts.

17. A hydration holder, said hydration holder comprising:

a bottle holder having a lower portion and an upper portion;

an elongated strip extending from said upper portion along a longitudinal centerplane and being fastened to said upper portion via a first fastener strip to form an upper loop, wherein said first fastener strip is oriented transversely and substantially perpendicular to said longitudinal centerplane;

whereby said elongated strip further extends towards and fastens to said lower portion via a second fastener strip thereby defining an inner handle member, wherein said second fastener strip is oriented transversely and substantially perpendicular to said longitudinal centerplane;

whereby said elongated strip further extends towards and terminates proximate to said upper portion thereby defining an outer handle member;

wherein said outer handle member is reversibly fastenable to said inner handle member via a handle member fastening means; and wherein said upper loop comprises two concavely rounded cuts.

* * * * *